US010788299B2

(12) United States Patent
Schandelmeier

(10) Patent No.: US 10,788,299 B2
(45) Date of Patent: Sep. 29, 2020

(54) SPEED DRUMS

(71) Applicant: Chad Schandelmeier, Melissa, TX (US)

(72) Inventor: Chad Schandelmeier, Melissa, TX (US)

( * ) Notice: Subject to any disclaimer, the term of this patent is extended or adjusted under 35 U.S.C. 154(b) by 0 days.

(21) Appl. No.: 15/904,561

(22) Filed: Feb. 26, 2018

(65) Prior Publication Data

US 2019/0265011 A1 Aug. 29, 2019

(51) Int. Cl.
*F42B 39/02* (2006.01)
*F41A 9/79* (2006.01)
*F42B 39/26* (2006.01)

(52) U.S. Cl.
CPC ..... *F42B 39/02* (2013.01); *F41A 9/79* (2013.01); *F42B 39/26* (2013.01)

(58) Field of Classification Search
CPC ..... F42B 39/00; F42B 39/02; F42B 39/26; F41A 9/79
USPC ..... 89/34
See application file for complete search history.

(56) References Cited

U.S. PATENT DOCUMENTS 1,658,997 A * 2/1928 Mulford ..... A45C 3/00 190/109
2,813,669 A * 11/1957 Frieder ..... F42B 39/02 206/3
5,289,958 A * 3/1994 Jay ..... A47C 4/52 224/153
9,637,294 B2 * 5/2017 Kinskey ..... B65D 25/22
2013/0319213 A1 * 12/2013 Simione ..... F42B 39/26 89/34
2015/0335140 A1 * 11/2015 Cole ..... A45F 5/02 24/3.7

FOREIGN PATENT DOCUMENTS

CA 2978257 * 9/2016

* cited by examiner

*Primary Examiner* — Stephen Johnson
(74) *Attorney, Agent, or Firm* — Kandace D Walter

(57) ABSTRACT

The speed drum is a storage container for spare ammunition for squad automatic weapons or machine guns. It is comprised of a bottom wall, front wall, back wall, side walls, side braces, connecting clips, and a flexible cord. Users can store, access, and replace ammunition single handedly, in a quick manner without removing both hands from their weapon. The side walls are curved, in the middle, to increase tension on the ammunition placed inside the speed drum and curved at the top, to reduce friction and snagging of the ammunition. Side braces secure the front wall and back walls. Connecting clips secure the device to equipment straps on the user's clothing or tactical vest. A flexible cord, attached to both the front wall and back wall, may be placed over the ammo drum inside the speed drum for additional stability and security until the spare ammunition drum is required.

11 Claims, 6 Drawing Sheets

SPEED DRUMS

The present disclosure relates generally to storage of ammunition for automatic weapons.

BACKGROUND

Military operations frequently make use of automatic weapons and machine guns, which use large amounts of ammunition over a short period of time. Once the ammunition is used, the operator of the automatic weapon must reload the ammunition to continue firing or discharging the weapon. A squad automatic weapon (SAW) is used to give infantry squads or sections a portable source of fully automatic firepower. Squad automatic weapons usually fire the same cartridge as the assault rifles or battle rifles carried by other members of the unit, which allows the entire unit to utilize a single type of ammunition for all weapons. Squad automatic weapons are light enough to be operated by one person who also carries ammunition refills. A speed drum is a container or pouch to carry or transport the ammunition drum. Oftentimes, the ammunition may be stored in a large pouch positioned at the exterior of the improvised outer tactical vest (IOTV) of the user, who may or may not be a soldier. In practice, a user would have one hand on the weapon and the other hand would be used to access and reload ammunition. Ammunition stored in a cloth or other flimsy pouch is usually difficult to access and manipulate with a single hand since the flimsy pouch will not maintain its shape or position as the user removes the ammunition. Soldiers often need to use both hands to deal with the ammunition pouch, which requires losing control of the weapon. Once the spare ammunition is removed from the pouch, the user will need to regain control of the weapon, insert the spare ammunition and prepare to fire the weapon again. Seconds wasted fumbling with ammunition and reloading can have deadly consequences for a soldier and their unit.

The present disclosure will assist users in their efforts to quickly reload ammunition in the SAW. In use, the user will continue holding the weapon with one hand and use the other hand to remove the speed drum and replace the ammunition in the SAW in a matter of seconds. The present invention is steady, sturdy and durable. It will maintain its shape with and without ammunition. It's also flexible enough to maintain a grip and some control over the ammunition within.

OBJECTIVES

An object of one embodiment of the present disclosure is to provide a user an easily accessible storage carrier or container for spare ammunition.

Another object of the present disclosure is to secure spare ammunition while maintaining a high level of accessibility to said ammunition.

An object of the present disclosure to provide an ammunition carrier that minimizes bulk and extraneous material that may hinder or delay the mission of the user.

Another object of the present disclosure is to provide an ammunition carrier that increases maneuverability of the user while reloading.

SUMMARY

Embodiments of the present disclosure, the speed drum, generally provide a storage container for spare ammunition used in automatic weapons or machine guns.

The speed drum is a container or case comprised of a bottom wall, front wall, back wall, side walls, side braces, connecting clips, and a flexible cord. The entire disclosure may be constructed from a single piece of material or the components may be constructed individually and assembled post production. The back wall is adjacent to the user's body and the front wall is facing the environment during use. The lower end of the back wall and the lower end of the front wall are connected to the front of the bottom wall and back of the bottom wall, respectively. The lower ends of both side walls are connected to the sides of the bottom wall. The middle section of the side walls are bent or curved inward towards the ammunition to increase tension on the ammunition placed inside the speed drum. The curved midsection of the side walls adds friction and pressure to maintain the position of the ammo drum inside the speed drum. Additionally, the top edge of the side walls is rolled outward to reduce friction and potential snagging of items on the ammo drum or the top edges of the side walls.

The flexible cord is attached to both the back wall and the front wall, which are identical. In use, the flexible cord would be placed over the ammo drum inside the speed drum. When not in use, the flexible cord may rest adjacent to the side wall or side brace, leaving the top of the speed drum open for potential insertion of an ammo drum. The bottom wall is at the bottom surface of the device, provides a resting surface for the ammo drum, and prevents the ammo drum from falling through the speed drum. The bottom wall is surrounded by the lower edges of both side walls, the front wall and the back wall.

The side braces are on the left and right sides of the speed drum. Each side brace connects the front wall to the back wall. The side braces also serve to securely connect the front wall to the back wall and make the speed drum sturdy. The side walls are behind the side braces and between the front and back wall. The side walls, behind the side braces and between the front wall and back wall, are bent inward with a rolled top to further secure the ammo.

Once the ammo drum is in place inside the speed drum, the flexible cord may be placed over the ammo drum inside the speed drum for further security. When the user decides to remove the ammo drum from the speed drum, the user will slide the flexible cord away from the ammo and lift the ammo out of the speed drum. The ammo may then be placed inside the SAW for continued firing of said weapon.

The speed drum may be constructed from a thermoplastic acrylic-polyvinyl chloride such as Kydex, types of polyethylene, polycarbonate, polymers, or a variety of other materials that are sturdy, durable, and flexible. The speed drum is durable and sturdy yet flexible enough to have curved and bent side walls to secure the ammo drum through pressure and friction. The speed drum may be constructed from a single piece of material or each component may be separate and connected with screws, rivets or other connection mechanisms such as staples, adhesives, and bolts. Connection mechanisms may be used to connect 1) the side brace to the front wall and back wall; 2) the connecting clips to the back wall of the speed drum; and 3) the flexible cord to the front wall and back wall. The connecting clips may be made of sturdy plastic similar to that used in a Malice® clip (an injection molded, heavy duty, reusable connecting clips that are designed to attach modular pouches to MOLLE style equipment), common among military users. The equipment straps may be constructed of heavy-duty nylon similar to the material used for MOLLE (Modular Lightweight Load-carrying Equipment) straps, also common among the military. Other technical features may be readily apparent to those skilled in the art from the included figures and descriptions.

BRIEF DESCRIPTION OF THE DRAWINGS

For a more complete understanding of this disclosure and its features, reference is now made to the following description, taken in conjunction with the accompanying drawings, in which.

FIGURE REFERENCES

Figure 1:
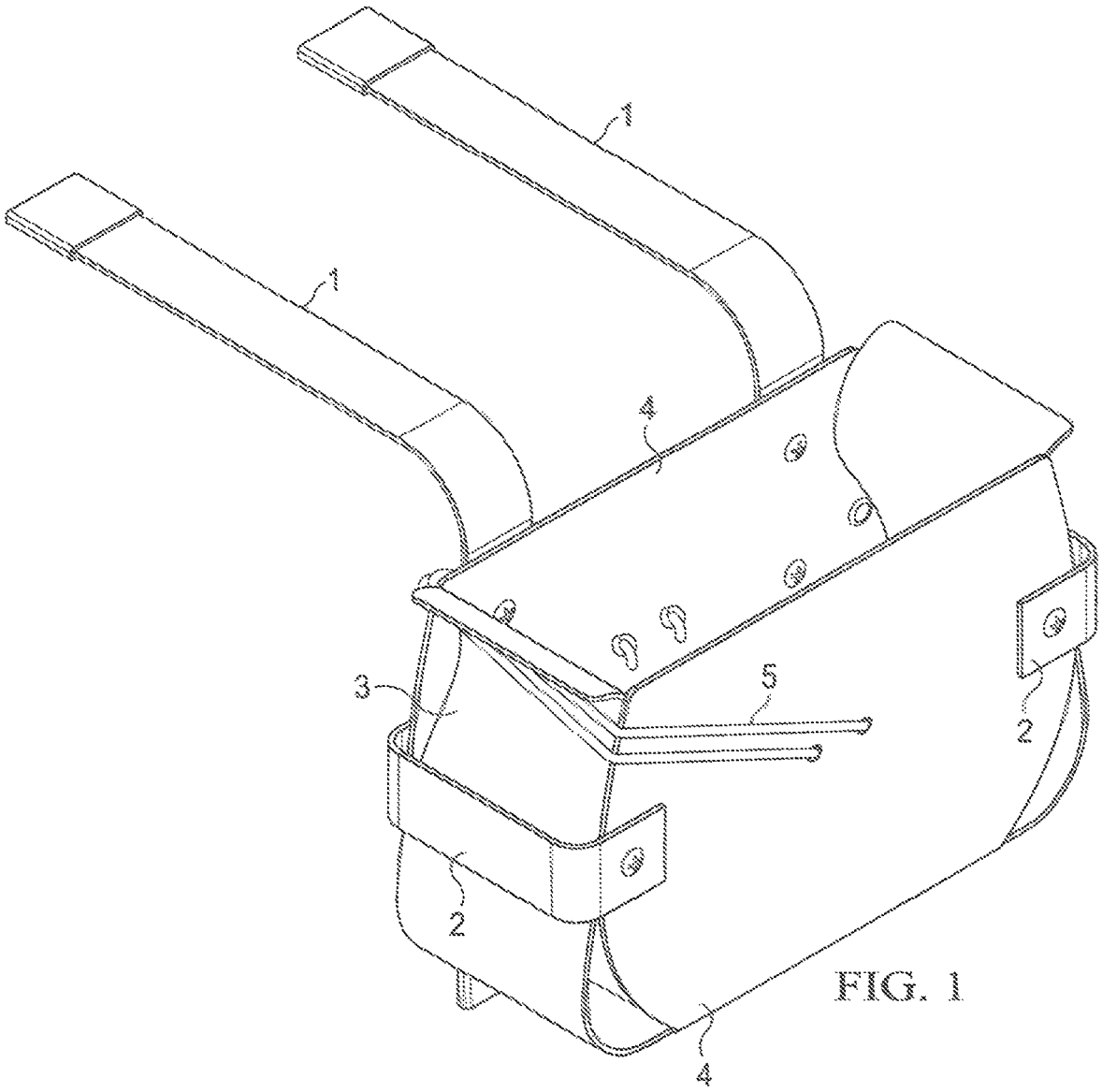
FIG. 1 shows a top perspective of the speed drum.

1) Connecting clips
2) Side brace
3) Side wall
4) Front/Back walls
5) Flexible cord
6) Bottom wall
7) Ammunition
8) Vest with equipment straps

DETAILED DESCRIPTION

The present disclosure generally provides storage of spare ammunition (i.e. ammo, ammunition drum, ammo round, ammunition round) for automatic weapons.

FIG. 1 shows a top perspective of the empty speed drum (case that holds spare ammunition drum). The speed drum is a container or case comprised of a bottom wall 6, front wall 4, back wall 4, side walls 3, side braces 2 and a flexible cord 5. The pair of side walls 3 are identical just as the front wall 4 and back wall 4 are identical to each other. A pair of connecting clips 1 are attached to the back wall 4 and the vest equipment straps 8 in use to secure the speed drum to the user. A first end of the connecting clips 1 are attached to the back wall 4 of the speed drum and the opposite end of the connecting clips 1 remains free. The free end of the connecting clips 1 can be woven through the equipment strips 8 of the IOTV. The back wall 4 is adjacent to the user's body wearing the IOTV and the front wall 4 is facing the environment. The bottom wall 6 is at the bottom surface of the device and prevents the ammunition round 7 from falling through the speed drum. The side braces 2 connect the front wall 4 to the back wall 4. The midsection of the side walls 3 are bent inward with a rolled top of the side wall to further secure the ammo 7 within the speed drum. Further, the side walls 3 are positioned behind the side braces 2 and between the front wall 4 and back wall 4. Once the ammo is in place inside the speed drum, the flexible cord 5 may be placed over the ammo 7 inside the speed drum for further security and stability while the user moves about his or her environment. When the user decides to remove the ammo 7 from the speed drum, the user will slide the flexible cord 5 away from the ammo 7 and lift the ammo 7 out of the speed drum. The ammo 7 may then be placed inside the SAW for continued firing of the automatic weapon.

Figure 2:
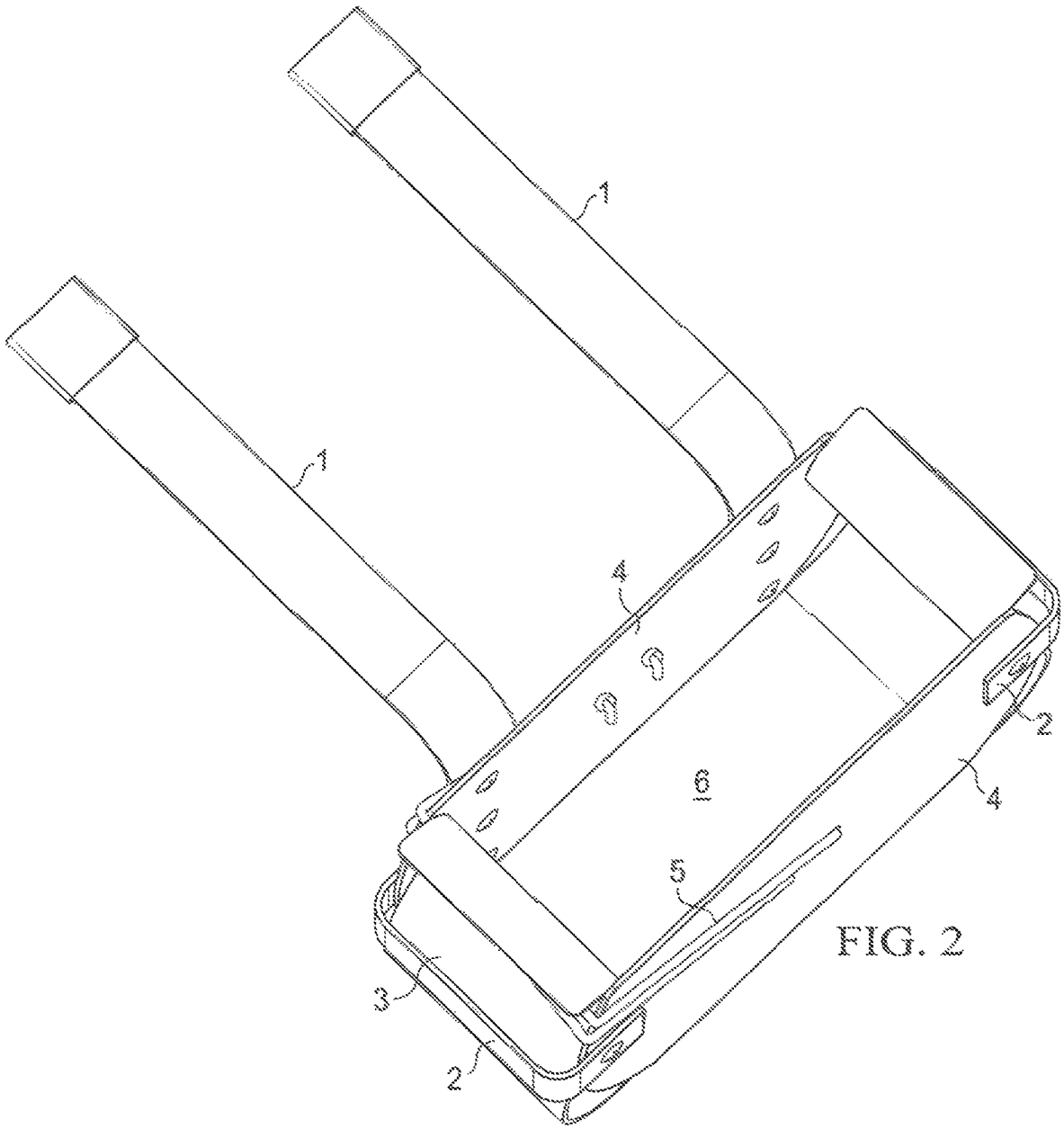
FIG. 2 shows a top view of the speed drum.

FIG. 2 shows a top view of the speed drum. The first ends of the pair of connecting clips 1 are attached to the back wall 4 of the speed drum and the opposite ends of the connecting clips 1 remains free. In use, the opposite ends of the pair of connecting clips 1 will be woven through the equipment straps 8 to connect the speed drum to the user's vest. The back wall 4 is adjacent to the user's body and the front wall 4 is facing the environment. The bottom wall 6 is at the bottom surface of the device and prevents the ammo round 7 from falling through the speed drum. The side braces 2 connect the front wall 4 to the back wall 4. The side walls 3, behind the side braces 2 and between the front wall 4 and back wall 4, are bent inward at the midsection of the side wall 3, with an outwardly curved top edge of the side wall 3 to further secure the ammo and prevent snagging. Once the ammo 7 is in place inside the speed drum, the flexible cord 5 may be placed over the ammo 7 inside the speed drum for further security.

Figure 3:
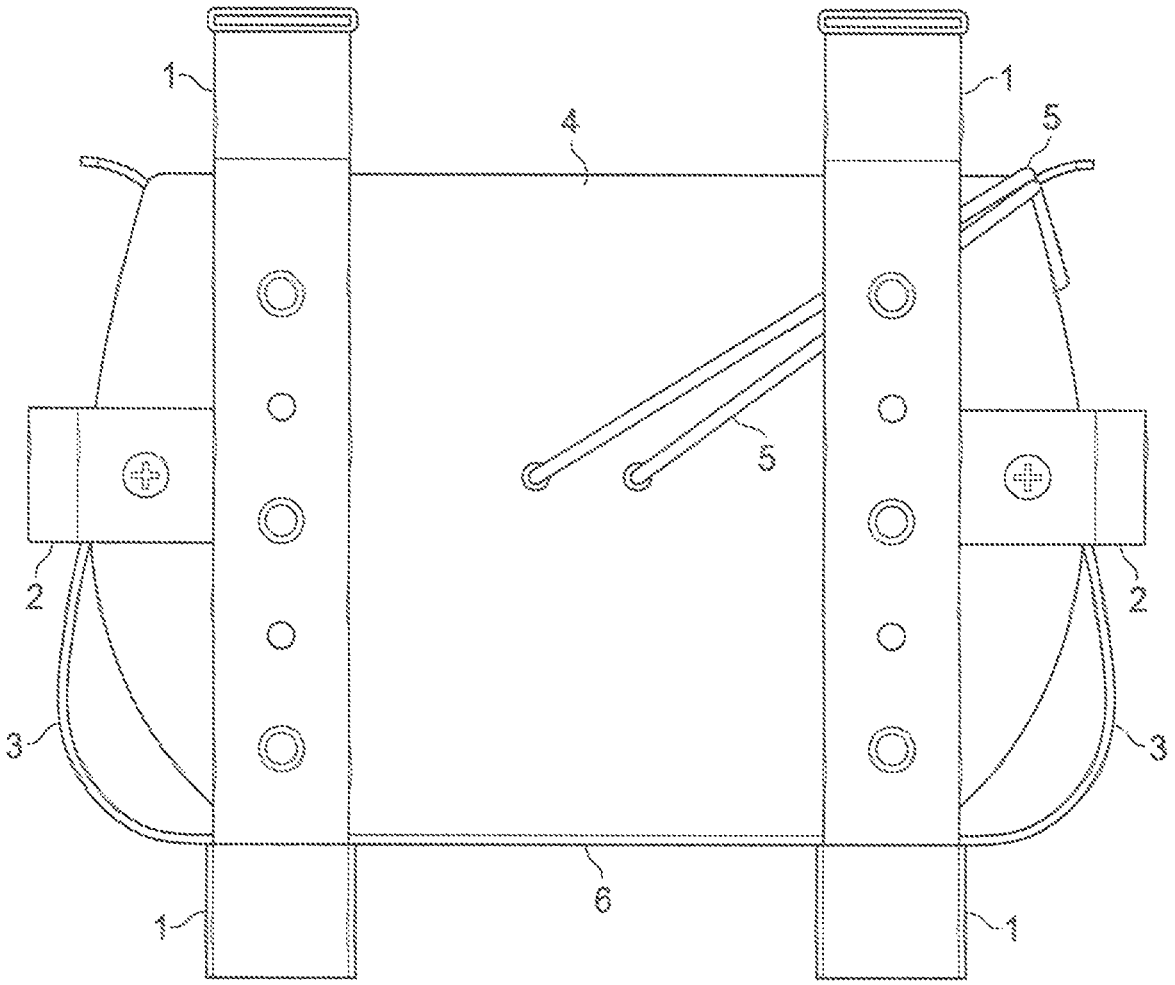
FIG. 3 shows rear perspective view of the speed drum.

FIG. 3 shows a rear view of the speed drum. In this view, the connecting clips 1 are visible adjacent to the back wall 4. The side braces 2 connect the front wall 4 to the back wall 4. The side walls 3, behind the side braces 2 and between the front wall 4 and back wall 4, are bent inward with a rolled top to further secure the ammo. Once the ammo 7 is in place on the bottom wall 6 and inside the speed drum, the flexible cord 5 may be placed over the ammo 7 inside the speed drum for further security.

Figure 4:
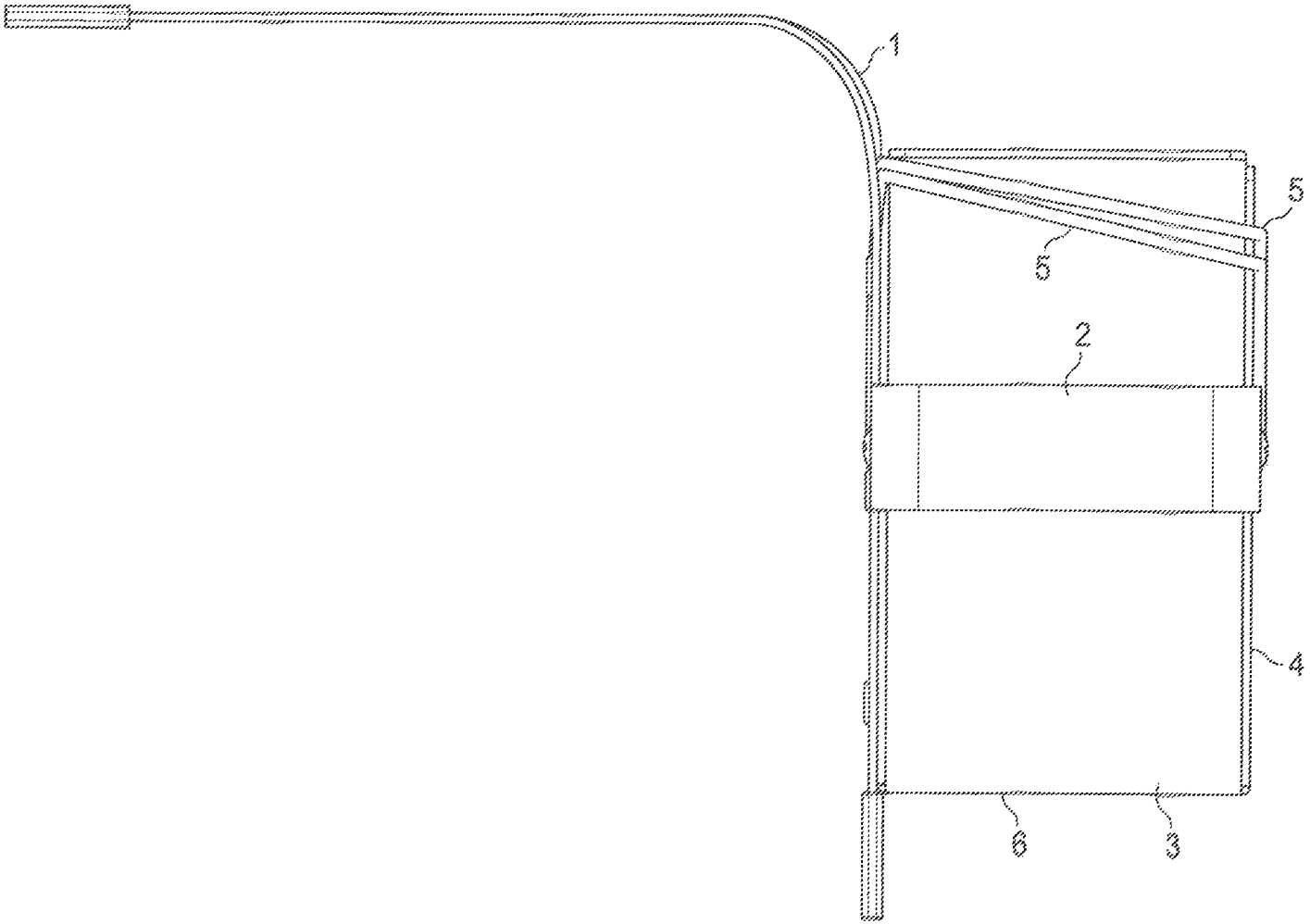
FIG. 4 shows a side view of the speed drum.

FIG. 4 shows a side view of the speed drum. The front wall 4 is facing the environment and adjacent from the back wall 4, next to the user's body. A first end of the pair of connecting clips 1 are attached to the back wall 4 of the speed drum and the opposite end of the connecting clips remains free. The side braces 2 connect the front wall 4 to the back wall 4. The side walls 3, behind the side braces 2 and between the front wall 4 and back wall 4, are bent inward with a rolled top to further secure the ammo 7. Once the ammo 7 is in place inside the speed drum, the flexible cord 5 may be placed over the ammo 7 inside the speed drum for further security.

Figure 5:
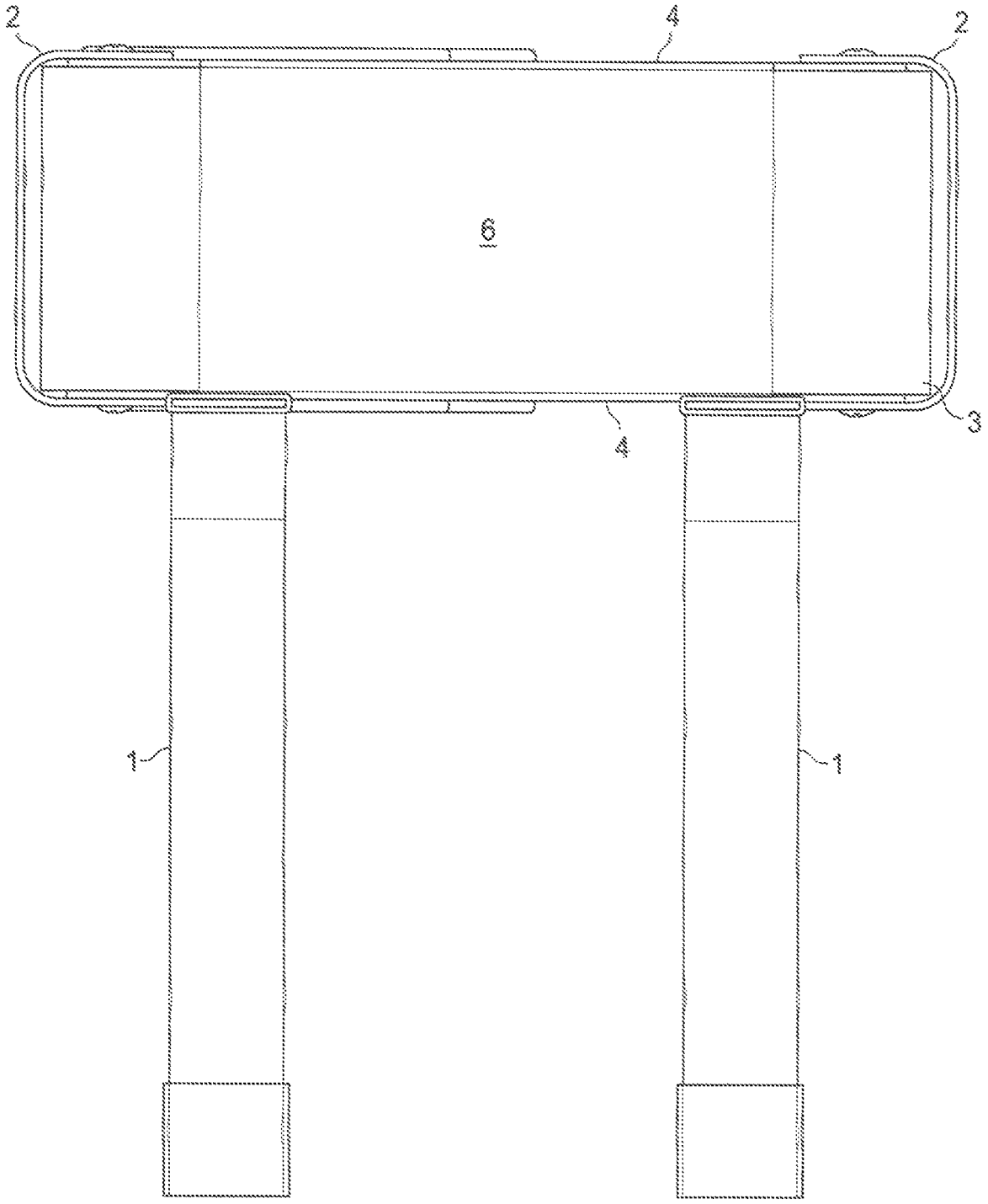
FIG. 5 shows a bottom view of the speed drum.

FIG. 5 shows a bottom view of the speed drum. The bottom wall 6 is at the bottom surface of the device and prevents the ammo round 7 from falling through the speed drum. The side braces 2 connect the front wall 4 to the back wall 4. The side walls 3, behind the side braces 2 and between the front wall 4 and back wall 4, are bent inward at the side wall 3 midsection with a rolled top edge of the side wall 3 to further secure the ammo.

Figure 6:
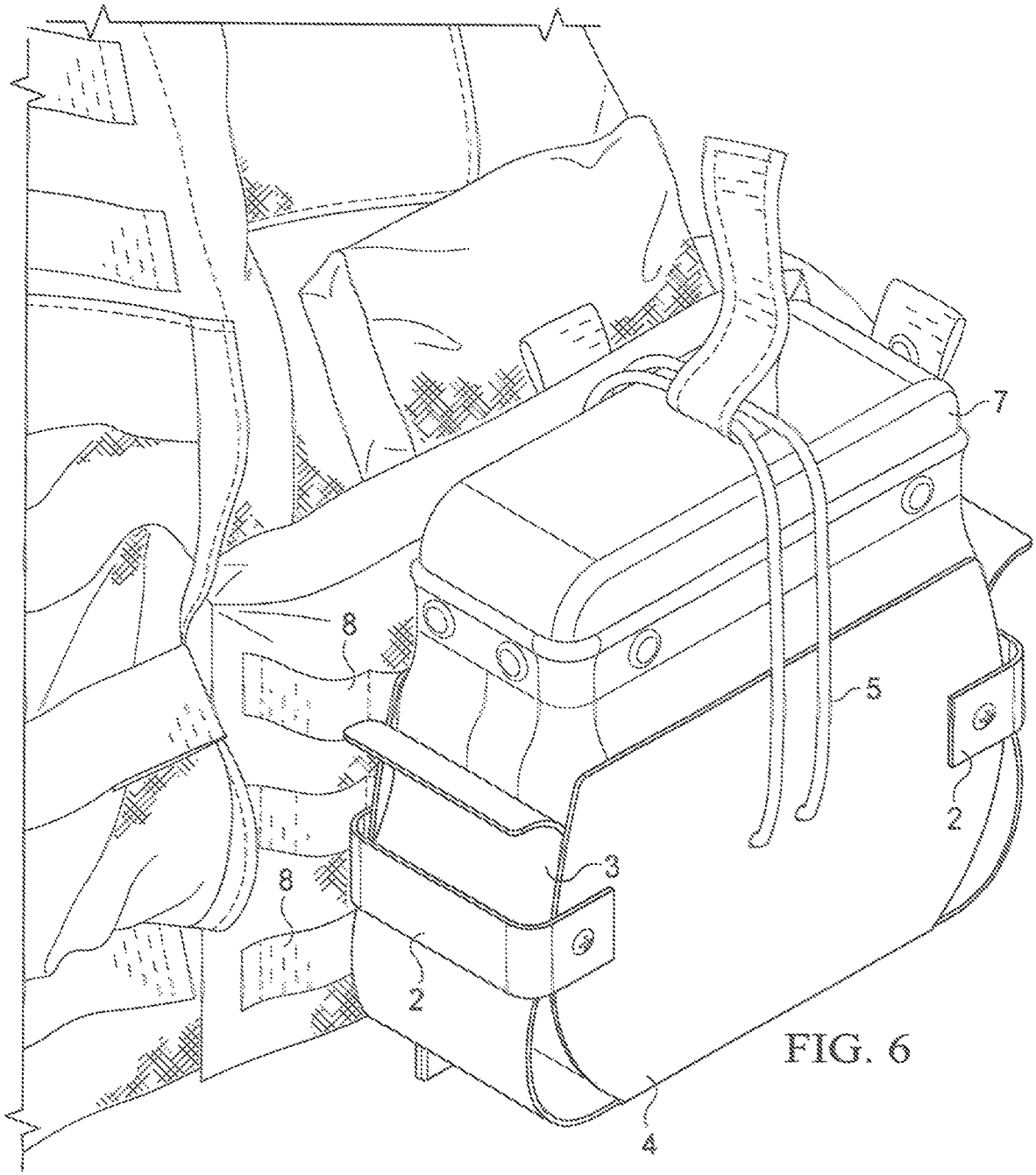
FIG. 6 shows a front perspective view of the speed drum with ammunition attached to the equipment straps of the IOTV.

FIG. 6 shows a front perspective view of the speed drum with ammunition 7 and a user's IOTV with equipment straps 8. The back wall 4 is adjacent to the user's body and the front wall 4 is facing the environment. The bottom wall 6 is at the bottom surface of the device and prevents the ammo round 7 from falling through the speed drum. The side braces 2 connect the front wall 4 to the back wall 4. The side walls 3, behind the side braces 2 and between the front wall 4 and back wall 4, are bent inward with a rolled top to further secure the ammo through tension created when the curved side wall 3 presses against the side of the ammunition 7. Once the ammo 7 is in place inside the speed drum, the flexible cord 5 may be placed over the ammo inside the speed drum for further security. When the user wants to remove the ammo, the flexible cord 5 can be moved or pushed to the side and the ammo 7 lifted from the speed drum.

It may be advantageous to set forth definitions of certain words and phrases used in this patent document. The term "couple" and its derivatives refer to any direct or indirect communication between two or more elements, whether or not those elements are in physical contact with one another.

The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure and the following claims.

What is claimed is:

1. A container for the storage of ammunition comprised of:

a front wall positioned opposite a back wall; wherein said front wall is comprised of a first end of said front wall opposite a second end of said front wall, wherein said back wall is comprised of a first end of said back wall opposite a second end of said back wall, a pair of side walls, wherein a first side wall is positioned opposite a second side wall, each said side wall comprised of an exterior surface and an interior surface, wherein a midsection of each of said side wall is curved, wherein a top edge of each said side wall is curved, wherein said first side wall is positioned between a said first end of said front wall and said first end of said back wall, and said second side wall is positioned between said second end of said front wall and said second end of said back wall; and a pair of side braces positioned around said exterior surfaces of said pair of side walls, wherein said side braces connect said front wall to said back wall; and a bottom wall.

2. The container of claim 1, wherein a pair of elongated connecting clip is comprised of a first end of said elongated connecting lips and a second end of elongated connecting clips, wherein said first end of said elongated connecting clips is adjacent to said back wall.

3. The container of claim 2, wherein flexible cord runs between said front wall and said back wall.

4. The container of claim 3, wherein said cord is elastic, wherein said cord is flexible.

5. The container of claim 1, wherein a middle section of said pair of side walls curves away from said side brace, wherein an upper section of said pair of side walls curves toward said side brace.

6. The container of claim 1, wherein said container is constructed from materials selected from the group consisting of thermoplastic, polyethylene, polycarbonate, and polymers.

7. The container of claim 2, wherein said connecting clip is plastic; wherein said side brace is plastic.

8. The container of claim 7, wherein a number of fastening mechanisms connect said connecting clip to said back wall, wherein said number of fastening mechanisms connect a first end of said side brace to said front wall; wherein said number of fastening mechanisms connect a second end of said side brace to said back wall.

9. The container of claim 8, wherein said number of fastening mechanisms are selected from the group consisting of: screw, rivet, staple, adhesive, and bolt.

10. The container of claim 2, wherein said second end of said clip is woven through a number of equipment straps on a user's vest for transport of said container.

11. The method of transporting a spare ammunition round in an ammunition storage container, comprised of:

Attaching a first end of a pair of elongated connecting clips to a back wall of an ammunition storage container; wherein said pair of elongated connecting clips is comprised of a first end of said elongated connecting clips and a second end of elongated connecting clips;

Inserting said second end of said pair of elongated connecting clips through a number of equipment straps on a user's vest;

Placing an ammunition round inside said ammunition storage container;

Resting said ammunition round on a bottom wall of said ammunition storage container; and Moving a cord above said ammunition round inside said ammunition storage container.

* * * * *